US007759852B2

(12) United States Patent
Geol

(10) Patent No.: US 7,759,852 B2
(45) Date of Patent: Jul. 20, 2010

(54) CATHODE RAY TUBE

(75) Inventor: Cha Joon Geol, Kyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 1111 days.

(21) Appl. No.: 11/406,240

(22) Filed: Apr. 19, 2006

(65) Prior Publication Data

US 2007/0040490 A1 Feb. 22, 2007

(30) Foreign Application Priority Data

Aug. 18, 2005 (KR) ..... 10-2005-0075962

(51) Int. Cl.
*H01J 29/64* (2006.01)

(52) U.S. Cl. ..... 313/440; 313/431

(58) Field of Classification Search ..... 313/421–440
See application file for complete search history.

(56) References Cited

U.S. PATENT DOCUMENTS

2002/0153825 A1* 10/2002 Matsuo et al. ..... 313/482

FOREIGN PATENT DOCUMENTS

CN 1386293 A 12/2002
EP 1 233 439 A1 8/2002
JP 5-217517 A 8/1993
JP 2001-84923 A 3/2001
JP 2003-303559 A 10/2003

* cited by examiner

*Primary Examiner*—Nimeshkumar D. Patel
*Assistant Examiner*—Christopher M Raabe
(74) *Attorney, Agent, or Firm*—Birch, Stewart, Kolasch & Birch, LLP

(57) ABSTRACT

A cathode ray tube in which a VM effect is maximized in a slim-type cathode ray tube having a short electric field in an anteroposterior direction. The cathode ray tube includes a panel having a fluorescent surface provided to raise colors, a shadow mask provided behind the fluorescent surface, a funnel connected to the rear portion of the panel to provide with an inner portion as an airtight space, an electron gun formed at the rear portion of the funnel for emitting an electron beam, a deflection yoke equipped outside of a neck portion of the funnel to deflect the electron beam, and a VM coil portion of which at least a portion inserted in an interval between the deflection yoke and the funnel to apply an electric field to the electron beam.

30 Claims, 6 Drawing Sheets

CATHODE RAY TUBE

This application claims the benefit of the Korean Patent Application No. 10-2005-0075962, filed on Aug. 18, 2005, which is hereby incorporated by reference as if fully set forth herein.

BACKGROUND OF THE INVENTION

1. Field of the Invention

The present invention relates to a cathode ray tube, and more particularly, to a cathode ray tube improving an image quality by maximizing velocity modulation (VM) effects. More particularly, the present invention relates to a slim-type cathode ray tube in which electric fields, i.e. dimensions, are decreased in an anteroposterior direction, and comprises a mounting structure where a VM coil portion, a shape and an icon is improved so as to obtain optimum VM effects.

2. Description of the Related Art

A cathode ray tube is an image forming device employed in a TV or a monitor. The image is formed by a light generated when an electron beam emitted from an electron gun hits a fluorescent surface of a panel of the cathode ray tube. Because the cathode ray tube generally has good color quality, little to no afterimage with respect to a moving image, a high brightness and a wide view angle, the cathode ray tube is widely used in a device displaying a moving image such as a TV. However, a general cathode ray tube usually includes an electron gun with a long electric field and a deflection yoke and requires a high vacuum inner space. Thus, the cathode ray tube requires a significant amount of space due to the long length in an anteroposterior direction, that is in a direction from the front of the cathode ray tube to the rear of the same.

Recently, a slim-type cathode ray tube has been suggested by improving the deflection yoke allowing the length of the cathode ray tube to be shortened in the anteroposterior direction. Significant improvements have been made to shorten the length of the cathode ray tube by shortening a length of other goods such as an electron gun in the anteroposterior direction.

FIG. 1 is a partial cross-sectional view of a conventional slim-type cathode ray tube. The configurations and operations of the conventional slim-type cathode ray tube now will be described with reference to FIG. 1.

First, in general, a cathode ray tube 1 is provided with a shape having a front glass called a panel 2 connected with a funnel 3, and the interior thereof is kept airtight. A fluorescent surface 16 is provided at the rear surface of the panel 2 such that when an electron beam 9 emitted from an electron gun 11 and deflected by a deflection yoke 10 hits a specific position of the fluorescent surface 16, a specific light is emitted to form an image.

Because the interior of the panel 2 and the funnel 3 is in a high vacuum state, constriction by implosion may occur due to an external impact. In order to prevent this, an external contact portion of the panel 2 and the funnel 3 may be made impact-resistant by a reinforcing band 15. A shadow mask 8 performing color classification functions is placed behind the fluorescent surface 16. A frame 6 supporting the shadow mask 8, a spring 5 and a stud pin 4 are also provided in the cathode ray tube 1. Moreover, an inner shield 7 for shielding the effects of geomagnetism during an operation of the cathode ray tube is formed in the frame 6.

The deflection yoke 10 for deflecting the electron beam 9 vertically/laterally is placed outside of a neck portion of the funnel 3 and a color purity magnet 12 CPM for improving a color purity is placed at behind the deflection yoke 10. Here, a rear portion of the funnel 3 is sealed using a material such as a glass and the electron gun 11 is placed within the sealed space. The deflection yoke 10 and the CPM 12 are placed at a rear portion of the sealed funnel 3.

The deflection yoke 10 deflects the electron beam 9 vertically/horizontally toward a specific position on the fluorescent surface 16. The CPM 12 includes a magnet 14 for correcting a convergence of the electron beam and a Velocity Modulation VM coil 13 for improving the image quality.

More particularly, a second differential signal of the image signal is input through a predetermined different circuit in the VM coil 13. The signal input to the VM coil 13 generates electric fields at a circumference portion of the VM coil 13, and the electric fields overlap with a horizontal magnetic field of the deflection yoke 10 to change a horizontal scanning velocity of an image line. The brightness on the screen changes in accordance with the changed velocity. If the deflection velocity is increased, the brightness at the portion is decreased and if the deflection velocity is decreased, the brightness at the portion is increased. Accordingly, since a difference of the brightness at an interface of dark and bright portions on the screen becomes larger than when the VM coil 13 is not included, the interfacial portion becomes clearer resulting in an improved clarity with respect to an outlined portion of the screen. This is called a VM effect.

To obtain the maximum VM effects, it is preferable that the VM coil is positioned at a focus electrode of the electron gun 11, i.e., outside of a G4 electrode of the electron gun. However, if the cathode ray tube is shortened in the anteroposterior direction such as with the slim-type cathode ray tube 1, a position where the CPM 12 can be mounted is limited by the deflection yoke 10, and thus, a position where the VM coil 13 can be placed is also limited. Therefore, the VM desirable effects cannot be obtained. In other words, the slim-type cathode ray tube has a shape so that the length of a neck portion of the electron gun 11 and the funnel 3 is shortened, and the CPM 12 is not placed at the focus electrode position of the electron gun 11 and instead, applies electric fields to other electrodes of the electron gun 11. For example, the VM coil 13 is positioned outside close to G1, G2 and G3 electrodes. In this case, the VM effects are reduced or non-existent.

In order to mitigate the above problems, a current applied to the VM coil may be increased. However, this increases power consumption which is undesirable. It is also possible to shorten the electric field of the deflection yoke by installing the VM coil more towards the front of the cathode ray tube. But in this case, a moving characteristic of the image and a sensitivity characteristic are decreased undesirably.

Another method to form an opening of a main electrode so as to increase the VM effects is suggested in Korean Patent Laid-open Publication No. 10-2003-0005605. However, in this case, the electric effects of an electrode is degraded, an integration of the electron beam is reduced even though the VM effects can be improved. Also, this presents a problem in the manufacturing process.

SUMMARY OF THE INVENTION

In order to mitigate the above-noted problems, it is an object of the present invention to provide a cathode ray tube capable of maximizing the VM effects by applying electric fields to an exact position of an electron gun by the VM coils.

In addition, it is another object of the present invention to provide with a cathode ray tube capable of improving the image quality by maximizing the VM effects.

Furthermore, it is an object of the present invention to provide a cathode ray tube capable of obtaining the maximum VM effects even if an electric field of an electron gun is shortened.

In order to obtain these and other advantages, an embodiment of a cathode ray tube comprises: a panel having a fluorescent surface provided to the inside to raise colors; a shadow mask provided behind the fluorescent surface; a funnel provided to a rear portion of the panel to provide with an inner portion as an airtight space; an electron gun formed at a rear portion of the funnel for emitting an electron beam; a deflection yoke equipped outside of at least a neck portion of the funnel to deflect the electron beam; and a VM coil portion of which at least a portion is inserted in an interval between the deflection yoke and the funnel to apply an electric field to the electron beam.

In accordance with another object of the present invention, an embodiment of a cathode ray tube comprises: a panel having a fluorescent surface provided to the inside to raise colors; a shadow mask provided behind the fluorescent surface; a funnel connected with the rear portion of the panel to provide with an inner portion as an airtight space; an electron gun sealed in the funnel for emitting an electron beam; a deflection yoke equipped outside of a neck portion of at least the funnel to deflect the electron beam; a magnet placed behind the deflection yoke; and a VM coil portion placed outside of the G4 electrode of the electron gun as other goods separated from the magnet.

In accordance with another aspect, an embodiment of a cathode ray tube comprises: a panel having a fluorescent surface provided to the inside to raise colors; a funnel connected with a rear portion of the panel to provide with an inner portion as an airtight space; an electron gun placed to a rear portion of the funnel for emitting an electron beam; a deflection yoke placed outside of the funnel to deflect the electron beam; a magnet placed behind the deflection yoke; and a VM coil portion of which at least a portion is inserted at an interval between the deflection yoke and the electron gun as a plate to generate the VM effects.

Even if the electric field of the cathode ray tube in anteroposterior direction is shortened, the cathode ray tube is stably placed and the maximum VM effects can be obtained. Furthermore, even if the length of electric fields is shortened further in the anteroposterior direction, a position of a VM coil can be changed. The embodiments of the present invention are advantageous in that high resolution image quality can be obtained without sacrificing the VM effects.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

The First Embodiment

Figure 1:
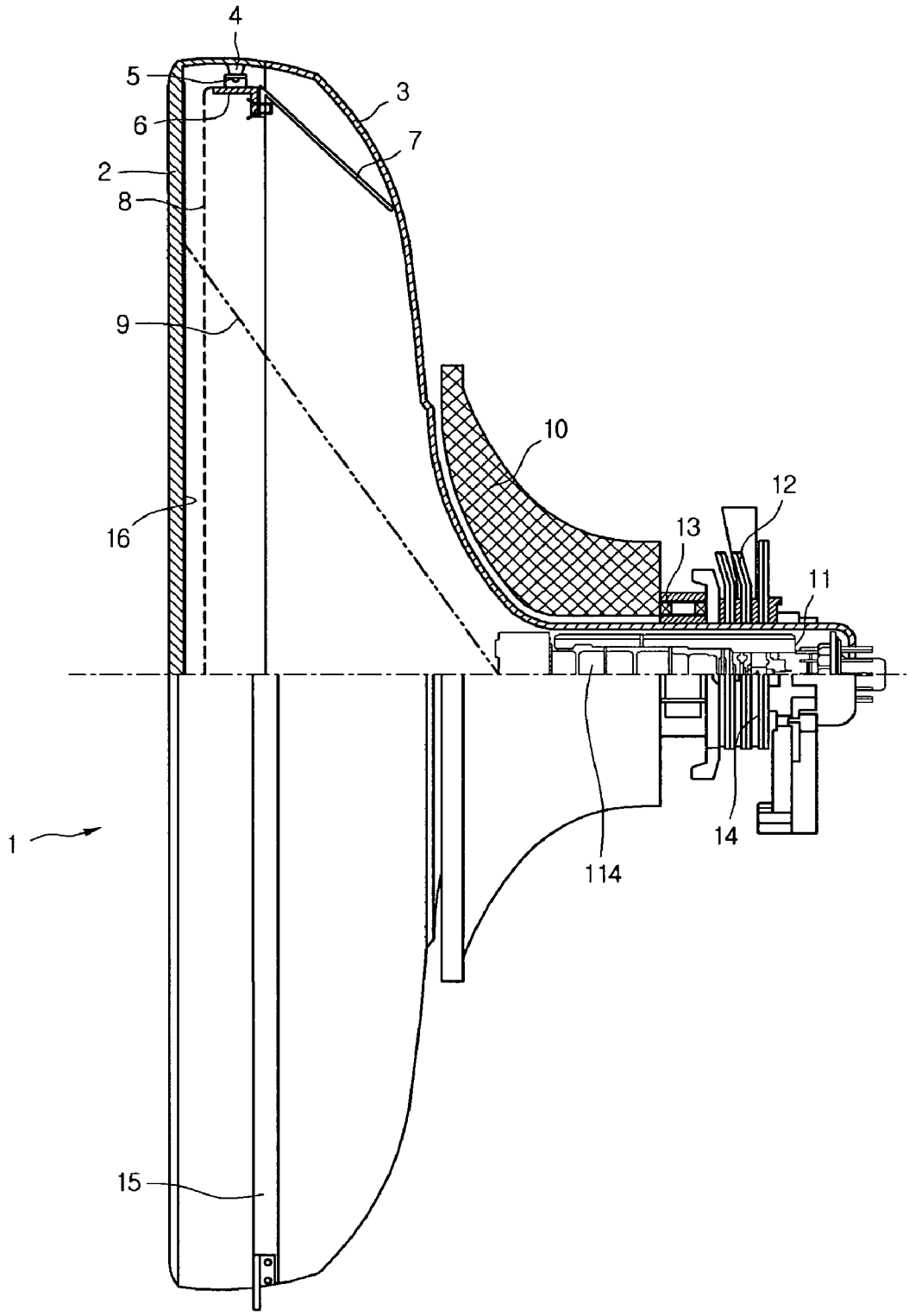
FIG.1 (BACKGROUND ART)
FIG. 1 is a partial cross-sectional view of a conventional slim-type cathode ray tube.
Figure 2:
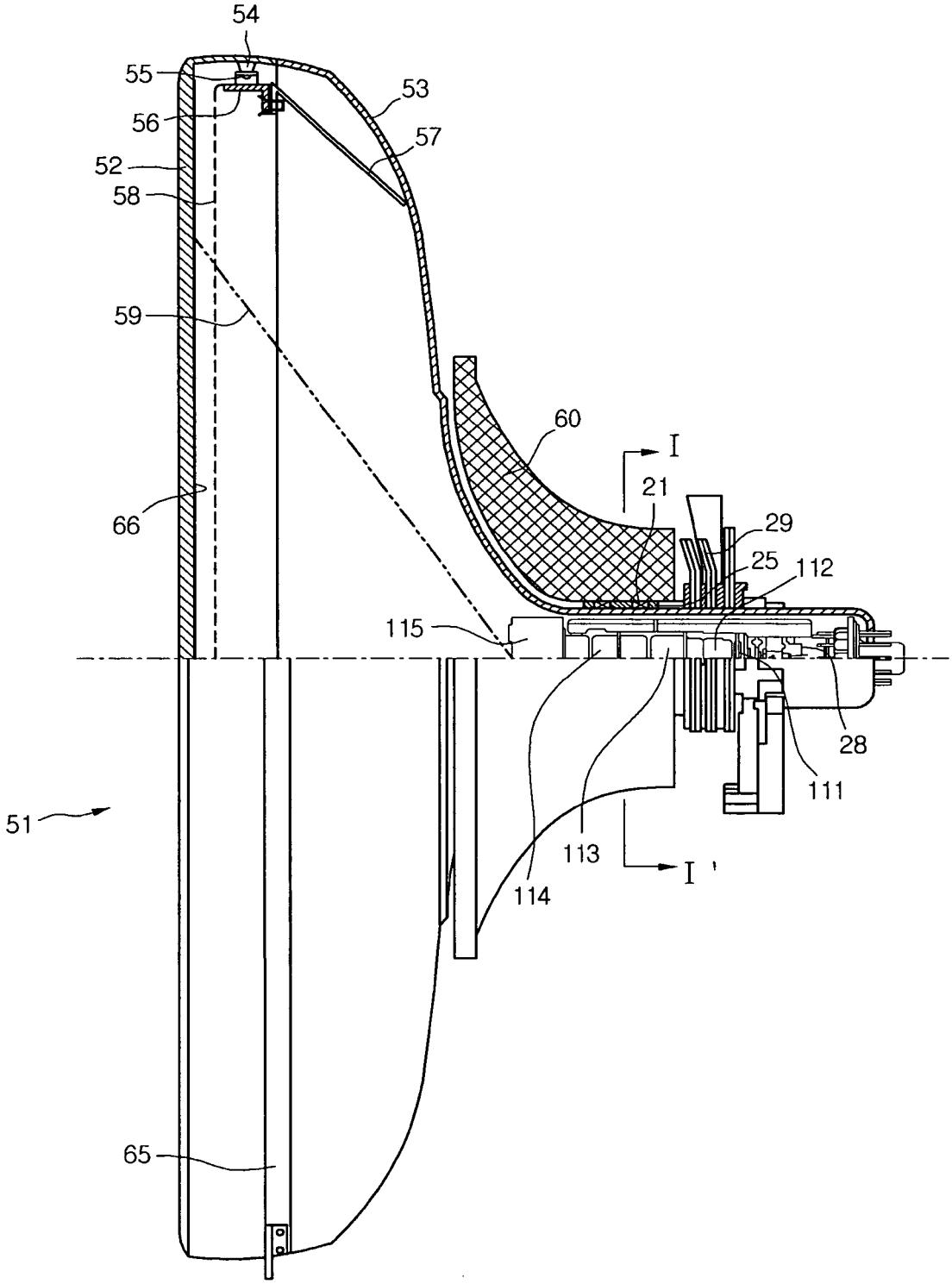
FIG. 2 is a partial cross-sectional view of a cathode ray tube in accordance with an embodiment of the present invention.

FIG. 2 is partial cross-sectional view of a cathode ray tube in accordance with an embodiment of the present invention.

Referring to FIG. 2, the cathode ray tube 51 includes a panel 52 connected with a funnel 53 forming a vacuum inner space sealed with respect to the outside. A fluorescent surface 66 is provided on a rear surface of the panel 52 and an electron beam 59 emitted from an electron gun 28 is deflected by a deflection yoke 60 to hit a specific position on the fluorescent surface 66 to form an image with the emitted specific colors.

The inner space of the panel 52 and the funnel 53 is in a high vacuum state. As such, an implosion can occur due to an external impact. To minimize or to prevent the implosion, a contact portion of the panel 52 and the funnel 53 is reinforced by a reinforcing band 65 to maximize an impact resistant capacity.

The cathode ray tube 51 includes a shadow mask 58 configured to perform a color distinction function positioned behind the fluorescent surface 66, a frame 56 supporting the shadow mask 58, a spring 55 and a stud pin 54. The frame 56 is connected with an inner shield 57 configured to shield the cathode ray tube 51 from the effects of terrestrial magnetism during an operation of the cathode ray tube.

In addition, the deflection yoke 60 configured to deflect the electron beam 59 vertically/horizontally is placed outside of a neck portion and toward a rear of the funnel 53. The electron beam 59 is deflected vertically/horizontally by the deflection yoke 60 to hit an appropriate position on the fluorescent surface 66.

Moreover, a magnet 29 is installed behind the deflection yoke 60 to perform a function of correcting a convergence. The magnet 29 may be in contact with the rear surface of the deflection yoke 60, or may be spaced apart with a predetermined interval. The position of the magnet 29 may be changed as necessary in accordance with a shape and length of the funnel 53, an installation position of the deflection yoke 60, placement of the electron gun 28, etc.

A VM coil portion 21 may be inserted in an interval between the deflection yoke 60 and the neck portion of the funnel 53, in other words, outside of the funnel 53 and in an inner space of the deflection yoke 60. The VM coil portion 21 position can be conveniently changed. For example, depending on position of the deflection yoke 60 with respect to the funnel 53, the depth with which VM coil portion 21 inserted within the interval can be changed and adjusted.

The VM coil portion 21 is preferred to be positioned near the G4 electrode 114 of the electron gun 28, which also includes a G1 electrode 111, a G2 electrode 112, a G3 electrode 113, and a G5 electrode 115 in addition to the G4 electrode 114. In other words, the VM coil portion 21 can be positioned outside and close to the focus electrode to maximize the VM effects.

Since the position of the VM coil portion 21 can be easily changed, the VM coil portion 21 can be placed at an appropriate place, e.g. outside of the G4 electrode 114, to obtain the desirable VM effects even though an electric field of the electron gun 28 is shortened. The brightness with respect to the outlined portion of the image is also corrected by the VM coil portion 21 to improve the image quality.

The VM coil portion 21 is illustrated as being entirely inserted in the interval between the deflection yoke 60 and the funnel 53 in FIG. 2. However, the invention is not so limited. In other words, only a part of the VM coil portion 21 may be inserted to overlap with the deflection yoke 60. The VM coil portion 21 may include a part that does not overlap the deflection yoke 60, behind the deflection yoke 60 for example, so that the VM coil portion 21 is positioned at G4 electrode 114 of the electron gun 28, i.e. at the outside of the focus electrode. The length and/or the shape of the cathode ray tube can be easily changed depending on the detailed specifications and the VM coil 21 can easily adapt to the changes.

Figure 3:
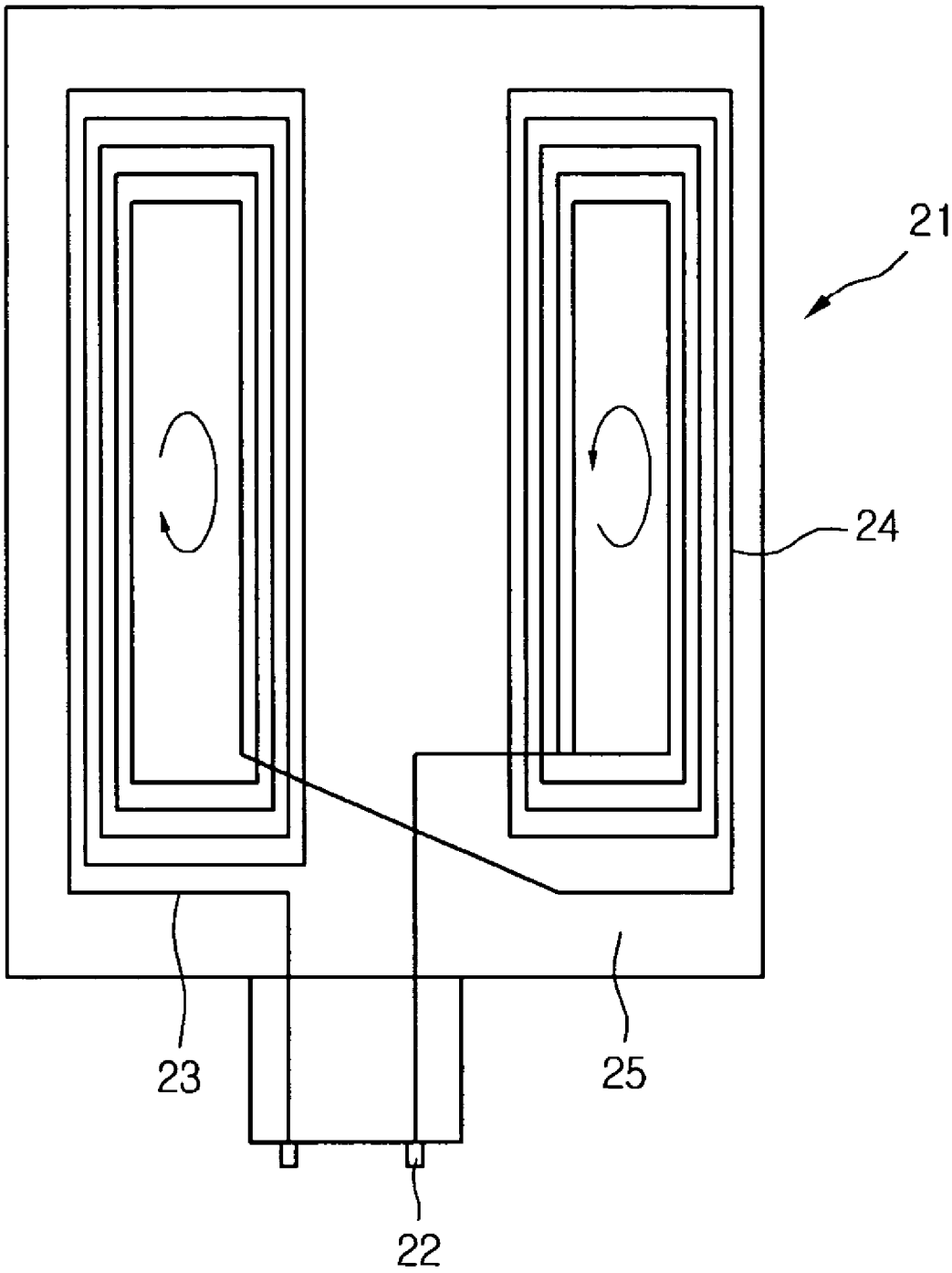
FIG. 3 is a plan view of a VM coil portion of a cathode ray tube in accordance with an embodiment of the present invention.

FIG. 3 is a plan view of a VM coil portion of a cathode ray tube in accordance with an embodiment of the present invention.

Referring to FIG. 3, the VM coil portion 21 according to the embodiment of the present invention includes a plurality of conductive lines printed on a flexible printed circuit board FPCB 25. The conductive lines include a pair of winding coils at different positions connected in series with each other. The coils include an upper VM Velocity Modulation coil 23 and a lower VM Velocity Modulation coil 24. The conductive lines connect with a connecting terminal 22 at the end for receiving the second differential signal of the image signal to the VM coils 23 and 24 from the outside. The upper VM coil 23 may be placed above the electron gun 28 (more specifically, above the focus electrode G4 of the electron gun 28) and the lower VM coil 24 may be placed below the electron gun 28 (more specifically, below the focus electrode G4 of the electron gun 28). In general, when the VM coil portion 21 is wrapped end to end to form a cylinder for example, it is preferred that the VM coils 23 and 24 be on opposite sides with respect to a center of an interior defined by the wrapped VM coil portion 21.

The VM coils 23 and 24 are wound so that the electric fields formed are oriented in the same direction. Moreover, it is preferred that the VM coils 23 and 24 are wound so that substantially uniform electric fields are applied to the focus electrode. This may be achieved, for example, by winding the coils in a square manner as illustrated. If the VM coils 23 and 24 are inserted in the interval between the deflection yoke 60 and the funnel 53 in a winding shape, the VM coils 23 and 24 are arranged in a saddle shape to apply substantially equal electric fields to an entire region of the focus electrode G4. As illustrated in FIG. 3, the upper portion of the VM coil portion 21 inserted in the interval between the deflection yoke 60 and the funnel 53 faces the front of the funnel and the connecting terminal 22 faces the rear of the funnel.

Figure 4:
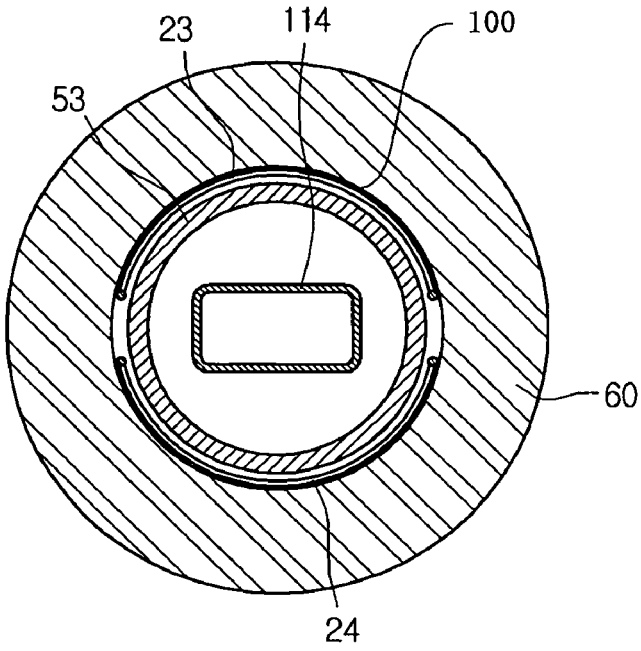
FIG. 4 is a cross-sectional view of the line I-I' in FIG. 2.

The flexible substrate 25 has a planar shape shown in FIG. 3, but when inserted in the interval between the deflection yoke 60 and the funnel 53, the substrate 25 wraps around the funnel 53 (see FIG. 4). The upper VM coil 23 is placed on or above the upper portion of the funnel 53 and the lower VM coil 24 is placed on or below the lower portion of the funnel 53. The VM coils 23 and 24 are placed on the upper portion and the lower portion of the electron gun, respectively, to apply relatively equal electric fields to the electron beam 59 if the electron beam 59 with three colors RGB are horizontally arranged. On the other hand, if the colors of the electron beam 59 are vertically arranged, then the VM coils 23 and 24 can be arranged to the left and the right side of the electron gun. In general, it is preferred to arrange the VM coils 23 and 24 to be substantially perpendicular to the arrangement of the colors of the electron beam.

In another embodiment, the flexible substrate 25 of the VM coil portion 21 may be a substrate of a plane type or a circularly winding type. Also, if the substrate is the circular type, a hard substrate may be used instead of the flexible substrate 25.

FIG. 4 is a cross-sectional view along the line I-I' in FIG. 2.

Referring to FIG. 4, the G4 electrode 114, i.e. the focus electrode, is placed closest to a center and the funnel 53, more specifically the neck portion of the funnel 53 is placed outside of the focus electrode 114. The inner space of the funnel 53 is maintained in a vacuum state as described above. The deflection yoke 60 deflecting the electron beam 59 vertically/horizontally is placed outside of the funnel 53 and also separated from the funnel 53 to define the interval therebetween. The VM coil portion 21 is placed in the interval between the inner surface of the deflection yoke 60 and the outer surface of the funnel 53 to apply electric fields to the G4 electrode 114 and thus, the deflection velocity of the electron beam 59 is changed to improve the image quality.

The VM coil portion 21 may rotate or otherwise move within the interval. Thus, a shaking preventing portion may be provided to prevent such movement. The shaking preventing portion may be implemented as a contact portion 100 so that the VM coil portion 21 contacts with a side of the deflection yoke 60 and/or the funnel 53. For example, the shaking preventing portion may include a first guide (not shown) formed at the VM coil portion 21 or a second guide (not shown) formed at the deflection yoke 60 and/or the funnel 53, and a connecting portion connecting the connecting terminal 22 with the deflection yoke 60 and/or the funnel 53 at a predetermined position. The shaking preventing portion can be embodied in various ways, and the detailed description is omitted.

As indicated above, according to an embodiment of the present invention, the VM coil portion may be separated from a magnet so that the positions are adjusted, and the position of the VM coils can be easily adjusted to maximize the VM effects. Therefore, the position of VM coils can be changed when the detailed specification of the cathode ray tube, such as the electron gun, is changed to conveniently move the VM coil into a proper position. Especially, even when a space for installing the VM coils such as in the slim-type cathode ray tube is relatively small, the VM coils can be positioned in the narrow interval between the deflection yoke and the funnel. Accordingly, the clarity of the image can be improved.

In addition, the positions installing the VM coils are not limited by other goods, and the VM coils can be placed at a desired position of the narrow and long interval between the deflection yoke and the funnel. Therefore, if an electric field of the G4 electrode 114 is long, an electric field due to a VM coil can be affected. Accordingly, it is advantageous that the VM effects can be realized at a low current state requiring less power consumption.

The Second Embodiment

The second embodiment of the present invention is substantially similar to the first embodiment except that the configuration and the shape of the VM coil portion are changed. Therefore, the portions which have not been described in the descriptions of the first embodiment and the changed portions are described in the present embodiment in detail.

Figure 5:
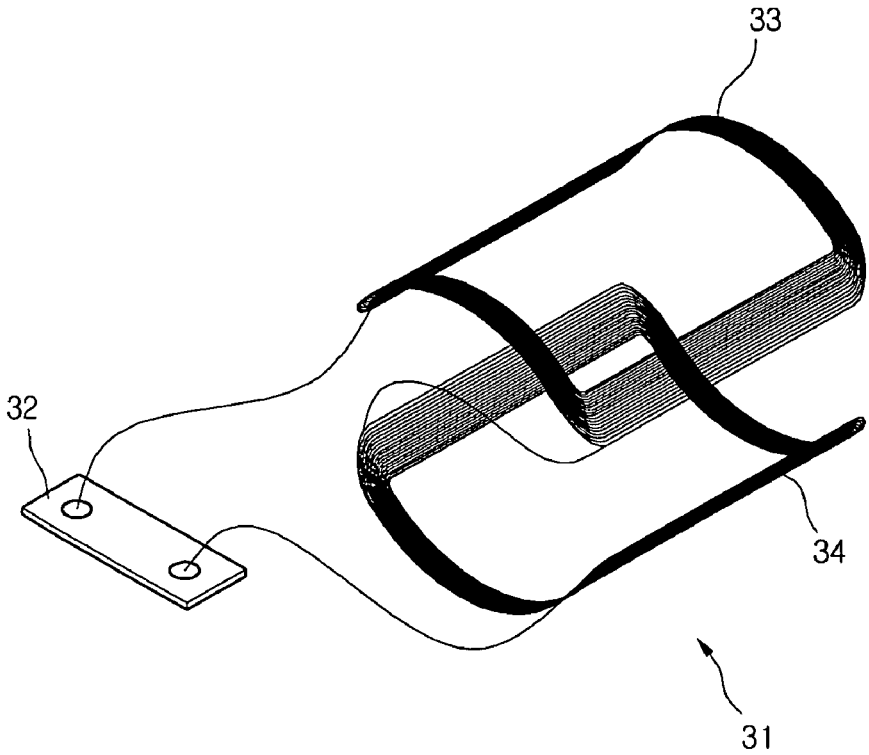
FIG. 5 is a perspective view of a VM coil portion in accordance with a second embodiment of the present invention.

FIG. 5 is a perspective view of a VM coil portion in accordance with the second embodiment.

Referring to FIG. 5, the VM coil portion 31 in accordance with the present embodiment includes an upper VM coil 33 connecting with a lower VM coil 34 in series and a connecting terminal 32 connected with the ends of the VM coils 33 and 34. The upper and lower VM coils 33 and 34 each generate an electric field by a conductive line that is wound a plurality of times.

As described above, the VM coils 33 and 34 maintain a predetermined shape by winding the conductive line having a regular intensity itself to obtain an advantage of reducing manufacturing costs. In addition, as the thickness of the conductive line increases, a conductive amount also increases. Each conductive line can be wound a plurality of times around the center of a specific position and the conductive pattern is formed on a curved plane which is different from the first embodiment. The second embodiment is advantageous that a uniformity of electric fields is increased and the intensity of the electric fields is strengthened.

The functions and the operations of the VM coils 33 and 34 are generally similar to those described in the first embodiment.

The Third Embodiment

The third embodiment of the present invention is similar to the second embodiment except that the VM coils are protected in a film.

Figure 6:
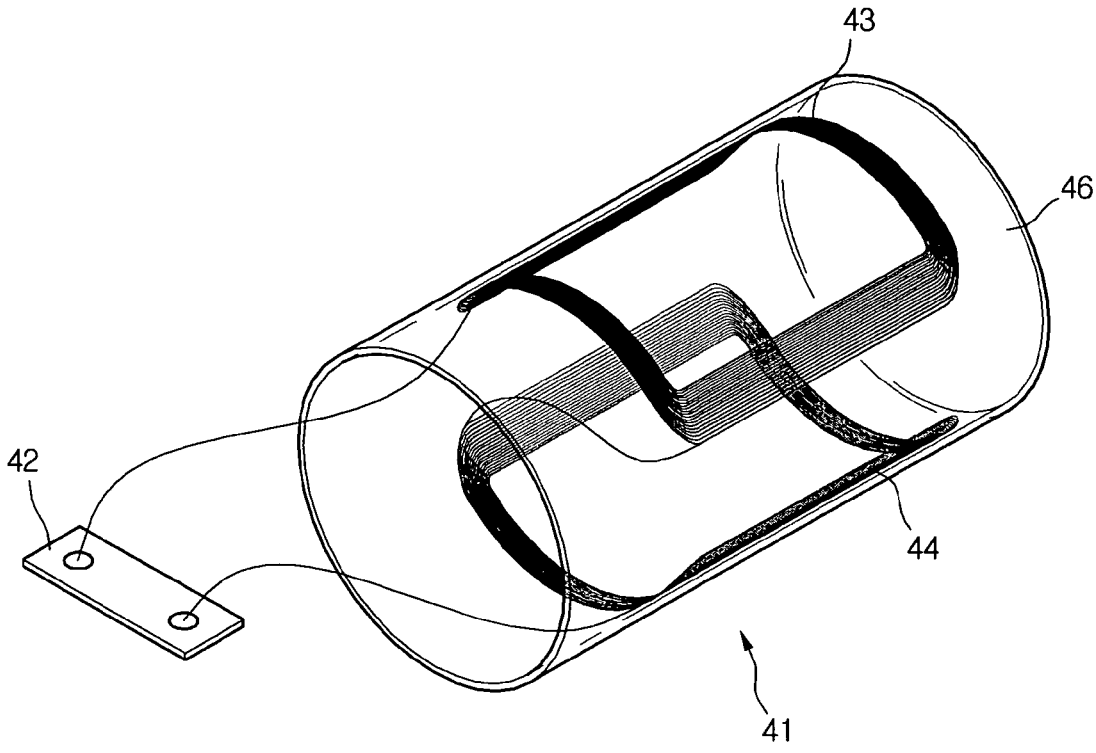
FIG. 6 is a perspective view of a VM coil portion in accordance with a third embodiment of the present invention.

FIG. 6 is a perspective view of a VM coil portion in the third embodiment of the present invention.

Referring to FIG. 6, the VM coil portion 41 includes an upper VM coil 43, a lower VM coil 44 and a connecting terminal 42, and the inner and/or outer surfaces of the upper VM coil 43 and the lower VM coil 44 are protected by the film 46. The film 46 also maintains the shapes of the VM coils 43 and 44 in a state where they are connected with each other.

The VM coils 43 and 44, maintained in their original state by the film 46, also prevents electric leakage by preventing the coils 43 and 44 from contacting with other goods.

The Fourth Embodiment

The fourth embodiment of the present invention is similar to the first, the second and the third embodiments except that the shape of the electron gun is changed to precisely control the positions of the electron beam by the VM coils.

Figure 7:
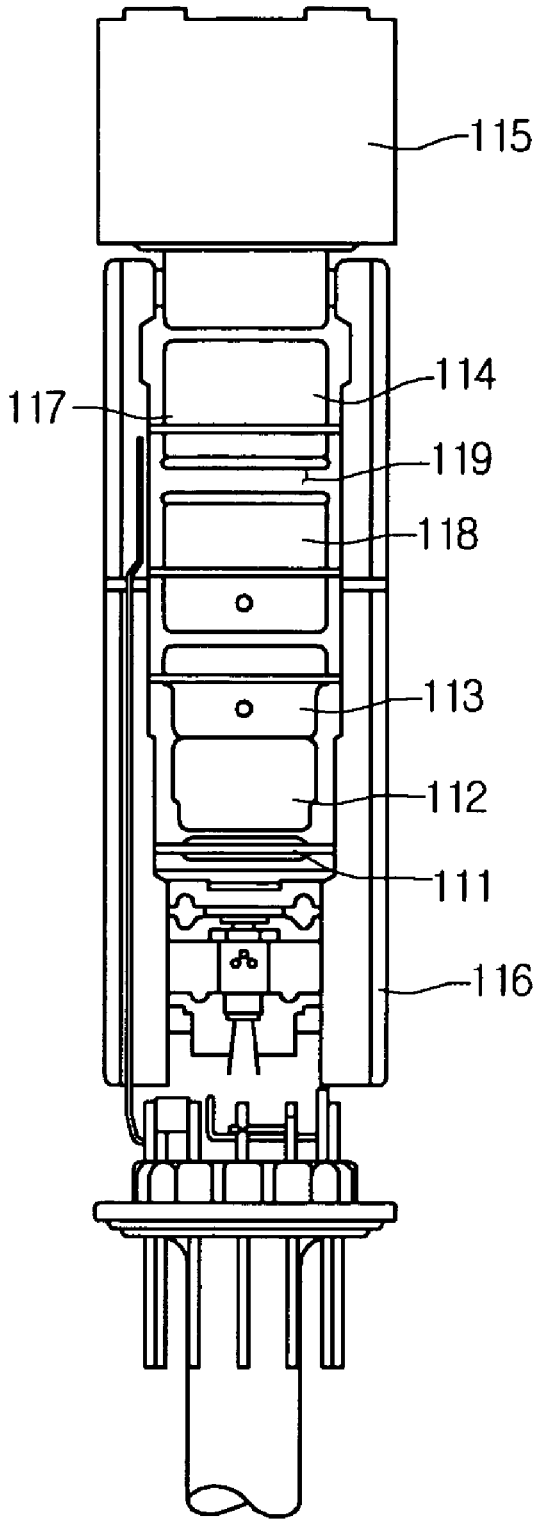
FIG. 7 is a perspective view of an electron gun in accordance with a fourth embodiment of the present invention.

FIG. 7 is a perspective view of an electron gun in accordance with the fourth embodiment of the present invention.

Referring to FIG. 7, the other portions of the electron gun 28 is similar to the first embodiment except that the G4 electrode 114 includes a first G4 electrode 117 and the second G4 electrode 118, and a VM gap 119 is formed between the first and the second G4 electrodes 117 and 118. The VM gap 119 improves a sensitivity of the VM coil portion.

When the VM gap 119 is present, i.e. the G4 electrode is divided, an eddy current degrading a velocity modulation due to the VM coils is minimized and an interval of an electron beam affected by an electric field due to the VM coil is increased. Accordingly, the VM effects can be improved even though a current flowing in the VM coil is relatively small. The present embodiment is possible in a slim-type cathode ray tube, because the VM coils of the present invention can be installed regardless of the shape and the position of the deflection yoke 60. Therefore, the embodiments of the VM coil of the present invention can be formed to have a length as long as possible. For example, if the deflection yoke 60 is not provided at a position where it is overlapped with the VM coil, the VM coil can be placed behind the deflection yoke 60.

The present embodiments have an advantage in that the VM effects are optimized.

With the embodiments of the present invention, at least a part of the VM coil portion can be arranged with the deflection yoke to conveniently change the position of installing VM coils, thereby maximizing the VM effects. The VM coils can be placed in the inner portion of the panel or can be placed in a single body with the neck portion and outside of the neck portion as the need arises and as other technical problems are addressed.

According to the embodiments of the present invention, the magnetic fields are applied to a precise electrode position of the electron gun by the VM coil to maximize the VM effects.

In addition, the VM effects are maximized at a low current state to improve the image quality, which has an advantage to reduce power consumption.

Furthermore, even if the magnetic field of a cathode ray tube is shortened due to the slimming of the cathode ray tube, the VM coil can be placed at an exact G4 electrode position of the electron gun, resulting in obtaining the maximum VM effects. In addition, since a scaffold to slim the cathode ray tube is provided, there is an advantage that the cathode ray tube can be slimmed further.

What is claimed is:

1. A cathode ray tube, comprising:

a panel having a fluorescent surface provided to an inside to raise colors;

a shadow mask provided behind the fluorescent surface;

a funnel connected to a rear portion of the panel to provide an inner portion as an airtight space;

an electron gun formed at a rear portion of the funnel for emitting an electron beam;

a deflection yoke equipped outside of a neck portion of the funnel to deflect the electron beam; and a VM coil portion, at least a part of the VM coil portion being inserted in an interval between the deflection yoke and the funnel to apply an electric field to the electron beam, wherein the VM coil portion is positioned such that an interior of the VM coil surrounds a focus electrode of the electrode gun.

2. The cathode ray tube of claim 1, wherein the VM coil portion includes:

an upper VM coil placed above an upper portion of the electron gun; and a lower VM coil placed below a lower portion of the electron gun.

3. The cathode ray tube of claim 1, wherein the VM coil portion includes a substrate provided with a conductive pattern.

4. The cathode ray tube of claim 1, wherein the VM coil portion includes a flexible substrate with a conductive pattern.

5. The cathode ray tube of claim 1, wherein the VM coil portion includes a wound conductive line.

6. The cathode ray tube of claim 1, wherein the VM coil portion includes:

a conductive line VM coil wound a plurality of times; and a film provided on at least one side of the conductive line VM coil.

7. The cathode ray tube of claim 1, wherein the VM coil portion includes a square-shaped VM coil wound a plurality of times.

8. The cathode ray tube of claim 1, wherein the focus electrode is divided into a plurality electrodes.

9. The cathode ray tube of claim 1, further comprising:

a magnet equipped behind the deflection yoke.

10. The cathode ray tube of claim 1, further comprising:

a shaking prevention portion configured to prevent a shaking of the VM coil.

11. A cathode ray tube, comprising:

a panel having a fluorescent surface provided to an inside to raise colors;

a shadow mask provided behind the fluorescent surface;

a funnel connected with a rear portion of the panel to provide an inner portion as an airtight space;

an electron gun sealed in the funnel for emitting an electron beam;

a deflection yoke equipped outside of a neck portion of the funnel to deflect the electron beam;

a magnet placed behind the deflection yoke; and a VM coil portion placed outside of a G4 electrode of the electron gun and separated from the magnet, wherein an interior of the VM coil surrounds the G4 electrode of the electrode gun.

12. A cathode ray tube, comprising:

a panel having a fluorescent surface provided to an inside to raise colors;

a funnel connected with a rear portion of the panel to provide an inner portion as an airtight space;

an electron gun placed at a rear portion of the funnel for emitting an electron beam;

a deflection yoke placed outside of the funnel to deflect the electron beam;

a magnet placed behind the deflection yoke; and a VM coil portion, at least a portion of the VM coil portion being inserted in an interval between the deflection yoke and the electron gun, wherein the VM coil portion is arranged to surround a G4 electrode of the electrode gun.

13. The cathode ray tube of claim 12, wherein the VM coil is placed outside of the funnel.

14. The cathode ray tube of claim 12, wherein the entire VM coil is inserted in the interval between the deflection yoke and the electron gun.

15. A cathode ray tube, comprising:

a panel to be placed at a front side;

a funnel connected with a rear of the panel to provide an inner portion as an airtight space;

an electron gun of which at least a part is inserted in the funnel for emitting an electron beam;

a deflection yoke placed outside of the funnel to deflect the electron beam;

a magnet placed behind the deflection yoke; and a VM coil, wherein at least a portion of the VM coil overlaps with the deflection yoke in an anteroposterior direction of the cathode ray tube, wherein the VM coil is arranged to surround a G4 electrode of the electrode gun.

16. The cathode ray tube of claim 15, wherein the VM coil includes a conductive pattern on a substrate.

17. The cathode ray tube of claim 15, wherein at least a part of the electron gun is overlapped with the deflection yoke in the anteroposterior direction.

18. A cathode ray tube, comprising:

a funnel connected to a panel such that an inner space is defined by the funnel and a panel;

an electron gun placed within a rear portion of the funnel, the electron gun configured to emit an electron beam towards the panel;

a deflection yoke placed between the panel and the electron gun and around a neck portion of the funnel, the deflection yoke configured to deflect the electron beam emitted from the electron gun; and a velocity modulation (VM) coil portion placed in an interval between an inner portion of the deflection yoke and an outer portion of the neck portion of the funnel, the VM coil portion configured to modulate the electron beam emitted from the electron gun, wherein at least a portion of the VM coil portion overlaps at least a portion of the deflection yoke and is arranged to surround a focus electrode of the electrode gun.

19. The cathode ray tube of claim 18, wherein the focus electrode of the electron gun includes a first electrode and a second electrode separated by a gap.

20. The cathode ray tube of claim 18, wherein the VM coil portion comprises:

a first conductive line wound a plurality of times;

a second conductive line wound a plurality of times; and a connecting terminal configured to deliver a differential signal to the first and second conductive lines.

21. The cathode ray tube of claim 20, wherein the first and second conductive lines are connected in series.

22. The cathode ray tube of claim 20, wherein the VM coil portion further comprises a substrate on which the first and second conductive lines are formed.

23. The cathode ray tube of claim 22, wherein the substrate is a flexible printed circuit board.

24. The cathode ray tube of claim 22, wherein the substrate is circular.

25. The cathode ray tube of claim 20, wherein the VM coil portion further comprises a protective film into which the first and second conductive lines are inserted.

26. The cathode ray tube of claim 20, wherein the first conductive line is rectangularly wound, or the second conductive line is rectangularly wound, or both the first and second conductive lines are rectangularly wound.

27. The cathode ray tube of claim 20, wherein the first and second conductive lines are wound such that electric fields produced by the first and second conductive line are substantially uniform within an interior defined by the VM coil portion.

28. The cathode ray tube of claim 20, wherein the VM coil portion surrounds at least a portion of a focus electrode of the electron gun such that the first conductive line is placed at an opposite side of the second conductive line with respect to the focus electrode.

29. The cathode ray tube of claim 28, wherein the first and second conductive lines are wound such that such that an orientation of an electric field produced by the first conductive line is substantially the same as an orientation of an electric field produced by the second conductive line.

30. The cathode ray tube of claim 28, wherein an arrangement of the first and second conductive lines is substantially perpendicular to an arrangement of RGB colors of the electron beam.

* * * * *